US008800070B2

(12) United States Patent
Hornberger

(10) Patent No.: US 8,800,070 B2
(45) Date of Patent: Aug. 12, 2014

(54) RIGID, ADJUSTABLE-LENGTH FLAPPER CONTROL ROD FOR A TOILET AND ASSOCIATED METHODS

(76) Inventor: Boyce Hornberger, Winter Springs, FL (US)

( * ) Notice: Subject to any disclaimer, the term of this patent is extended or adjusted under 35 U.S.C. 154(b) by 721 days.

(21) Appl. No.: 12/815,219

(22) Filed: Jun. 14, 2010

(65) Prior Publication Data

US 2010/0313346 A1 Dec. 16, 2010

Related U.S. Application Data

(60) Provisional application No. 61/187,097, filed on Jun. 15, 2009.

(51) Int. Cl.
*E03D 5/09* (2006.01)
*E03D 1/30* (2006.01)
*E03D 5/092* (2006.01)

(52) U.S. Cl.
CPC ..... *E03D 5/092* (2013.01); *E03D 1/306* (2013.01)
USPC ..... 4/413; 4/324

(58) Field of Classification Search
USPC ..... 4/324, 325, 327, 329, 394, 411, 412, 4/413, 414, 415
See application file for complete search history.

(56) References Cited

U.S. PATENT DOCUMENTS

| | | | | | |
|---|---|---|---|---|---|
| 1,718,744 | A | * | 6/1929 | Koropczyk | 4/324 |
| 2,746,061 | A | * | 5/1956 | Bennett | 4/412 |
| 2,803,833 | A | | 8/1957 | Charest | |
| 3,696,775 | A | * | 10/1972 | Markart | 116/67 A |
| 4,014,050 | A | | 3/1977 | Goldsworthy | 4/67 |
| 4,091,474 | A | * | 5/1978 | Makhobey | 4/379 |
| 4,183,107 | A | | 1/1980 | Hare et al. | 4/324 |
| 4,184,215 | A | * | 1/1980 | Birdsall | 4/411 |
| 5,023,960 | A | | 6/1991 | Ratanagsu | 4/393 |
| 6,401,269 | B1 | | 6/2002 | Andersen et al. | 4/393 |

* cited by examiner

*Primary Examiner* — Huyen Le
*Assistant Examiner* — Lauren Heitzer
(74) *Attorney, Agent, or Firm* — Allen, Dyer, Doppelt, Milbrath & Gilchrist, P.A.

(57) ABSTRACT

A flush toilet is configured to permit user control of a flush cycle time and corresponding water usage. The toilet includes a bowl and a tank in fluid communication with the bowl. A flush handle assembly may be carried by the tank and may have a flush handle and a lever arm coupled thereto. In addition, there may be a flapper valve in the tank, and a rigid, adjustable-length, flapper control rod coupled between the lever arm and the flapper valve. Operation of the flush handle in a first direction may open the flapper valve, and operation of the flush handle in a second direction may close the flapper valve. This permits user control of the flush cycle time and corresponding water usage.

13 Claims, 8 Drawing Sheets

RIGID, ADJUSTABLE-LENGTH FLAPPER CONTROL ROD FOR A TOILET AND ASSOCIATED METHODS

RELATED APPLICATION

This application is based upon prior filed provisional application Ser. No. 61/187,097 filed Jun. 15, 2009, the entire subject matter of which is incorporated herein by reference in its entirety.

FIELD OF THE INVENTION

The present invention relates to the field of toilets, and, more particularly, to flapper actuators for toilets and related methods.

BACKGROUND OF THE INVENTION

In a time where humans are increasingly using up the Earth's natural resources, water conservation is of global concern. Referring to FIG. 1, the mechanism by which a conventional toilet 10 is flushed includes a handle 11, a flapper valve 14, a lever 12 connected to the handle, and a flapper chain 13 coupling the handle to the flapper valve. When the handle 11 is actuated, the lever 12 pulls the flapper chain 13 upward, thereby opening the flapper valve 14. The buoyancy of the flapper valve 14 keeps the flapper valve open for a period of time, as water from the tank empties into the bowl of the toilet. Eventually, the handle 11, lever 12, and the flapper valve 14 return to their original position, and the flapper valve again forms a seal between the tank and the toilet, because the system is weight biased toward the flapper valve and not the handle.

Such a system, however, may waste water, as more water may empty from the tank into the toilet bowl during the time it takes for the flapper valve 14 to settle and once again form a seal between the tank and the toilet bowl than is necessary to clean the toilet bowl. In an attempt to address this concern, there have been various methods and inventions designed to control the amount of water used in conventional toilets. Each method has been of varying complexity but none have succeeded in providing for an easy conversion of most existing flush mechanisms to a system capable of controlling the volume of water used during a flush.

Prior methods have included U.S. Pat. No. 4,014,050 to Goldsworthy, disclosing a rod on a ball valve system that could be applied to a flapper. In particular, Goldsworthy discloses a toilet flushing apparatus including a handle, and a lever coupled to the handle. As the handle is turned, the lever advances or retracts a rigid flapper rod that is coupled to a flapper valve. Goldsworthy, however, does not permit manual lowering of the lift rod. Rather, Goldsworthy employs a timing mechanism to lower the lift rod. This adds complexity and cost to the system.

Other variable flush controls devices include U.S. Pat. No. 2,803,833 to Charest. Charest discloses a toilet flush tank valve assembly comprising an outlet pipe and having an inlet opening and an overflow pipe in fluid communication with the outlet pipe. An inlet fitting is on the overflow pipe. A first valve is for closing the inlet opening and a second valve is for closing the inlet fitting. A handle is coupled to a rigid linkage for moving the first and second valves to open positions. This invention again, however, replaces the typical internal mechanisms of a toilet. As such, the retrofitting thereof into existing toilets may be undesirably expensive and complex.

U.S. Pat. No. 5,023,960 to Ratanagsu discloses a toilet flapper valve control apparatus including a conventional flapper chain coupled to a handle to open the flapper valve when the handle is actuated. A float block adjacent the flapper valve closes the flapper valve after a given period of time.

U.S. Pat. No. 6,401,269 to Andersen et al. discloses a flapper valve assembly for regulating the passage of water from a toilet tank. A yoke is pivotally disposed in the tank and supports a flapper valve. A flapper arm has a first segment coupled to the yoke along a pivot axis and a second segment extending away from the pivot axis toward the flapper seal. The flapper arm is configured so that it delays seating of the flapper valve when the water in the tank is above a predetermined level and assists seating of the flapper valve when the water is below a designated level. Again this is a replacement of the conventional system of a handle to actuate a flapper valve via a flapper chain. Thus, the retrofitting thereof into existing toilets may be undesirably expensive and complex.

U.S. Pat. No. 4,183,107 to Hare et al. includes a flapper chain coupled to a medial portion of a U shaped rod. One end of the U shaped rod is coupled to the flapper valve so that the chain may open the flapper valve. The other end of the U shaped rod is coupled to a weight, which therefore exerts a downward force on the U shaped rod, closing the flapper valve after it has been opened.

U.S. Pat. No. 4,184,215 to Birdsall discloses the replacement of the traditional system comprising a handle and a flapper valve actuated by the handle via a flapper chain with a weighted handle and a weight held in position by a rod or chain attached to the flapper valve. The valve is opened in the usual fashion by lifting the flapper valve off of the valve. The weighted handle than keeps the weighted flapper valve open with the handle held in the down position. The flapper valve may be manually closed by lifting the handle, thereby, removing the lift that is keeping the weighted flapper valve open, and thus allowing the weighted flapper valve to close. This system, however, replaces multiple parts of a conventional toilet and, as such, may be undesirably expensive to produce and time consuming to install.

Therefore, additional devices which close the flapper valve of a toilet more quickly to thereby conserve water may be desirable. Moreover, such devices which are simple and cheap to produce, as well as easy to install, may be particularly desirable.

SUMMARY OF THE INVENTION

A flush toilet may be configured to permit user control of a flush cycle time and corresponding water usage. The toilet may comprise a bowl and a tank in fluid communication with the bowl. A flush handle assembly may be carried by the tank and may comprise a flush handle and a lever arm coupled thereto. In addition, there may be a flapper valve in the tank, and a rigid, adjustable-length, flapper control rod coupled between the lever arm and the flapper valve. Operation of the flush handle in a first direction may open the flapper valve, and operation of the flush handle in a second direction may close the flapper valve, thereby permitting user control of the flush cycle time and corresponding water usage.

In some application, the rigid, adjustable-length flapper rod may be a series of elongate segments with at least one adjustable length joint therebetween. At least one adjustable length joint may comprise at least one threaded joint. In addition, adjacent elongate segments may have threaded ends. The at least one adjustable length joint may be a threaded barrel receiving the threaded ends.

The at least one adjustable length joint may comprise at least one slidable friction joint. Furthermore, adjacent elongate segments may have corresponding male and female ends defining the at least one slidable friction joint.

The rigid, adjustable-length flapper rod may have a body portion and first and second hook ends coupled thereto. At least one of the first and second hook ends may have a triangular shape. At least one of the first and second hook ends may include four continuous segments with the first three segments defining a triangle and the fourth segment lying parallel to the first segment and in spaced relation therefrom.

A method aspect is directed to a method of retrofitting a toilet to permit user control of a flush cycle time and corresponding water usage, the toilet comprising a bowl, a tank in fluid communication with the bowl, a flush handle assembly carried by the tank and comprising a flush handle with a lever arm coupled thereto, and a non-rigid, flapper control member coupled between the lever arm and a flapper valve in the tank. The method may include removing the non-rigid flapper control member.

The method may also include coupling a rigid, adjustable-length, flapper control rod between the lever arm and the flapper valve so that operation of the flush handle in a first direction opens the flapper valve and so that operation of the flush handle in a second direction closes the flapper valve thereby permitting user control of the flush cycle time and corresponding water usage.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
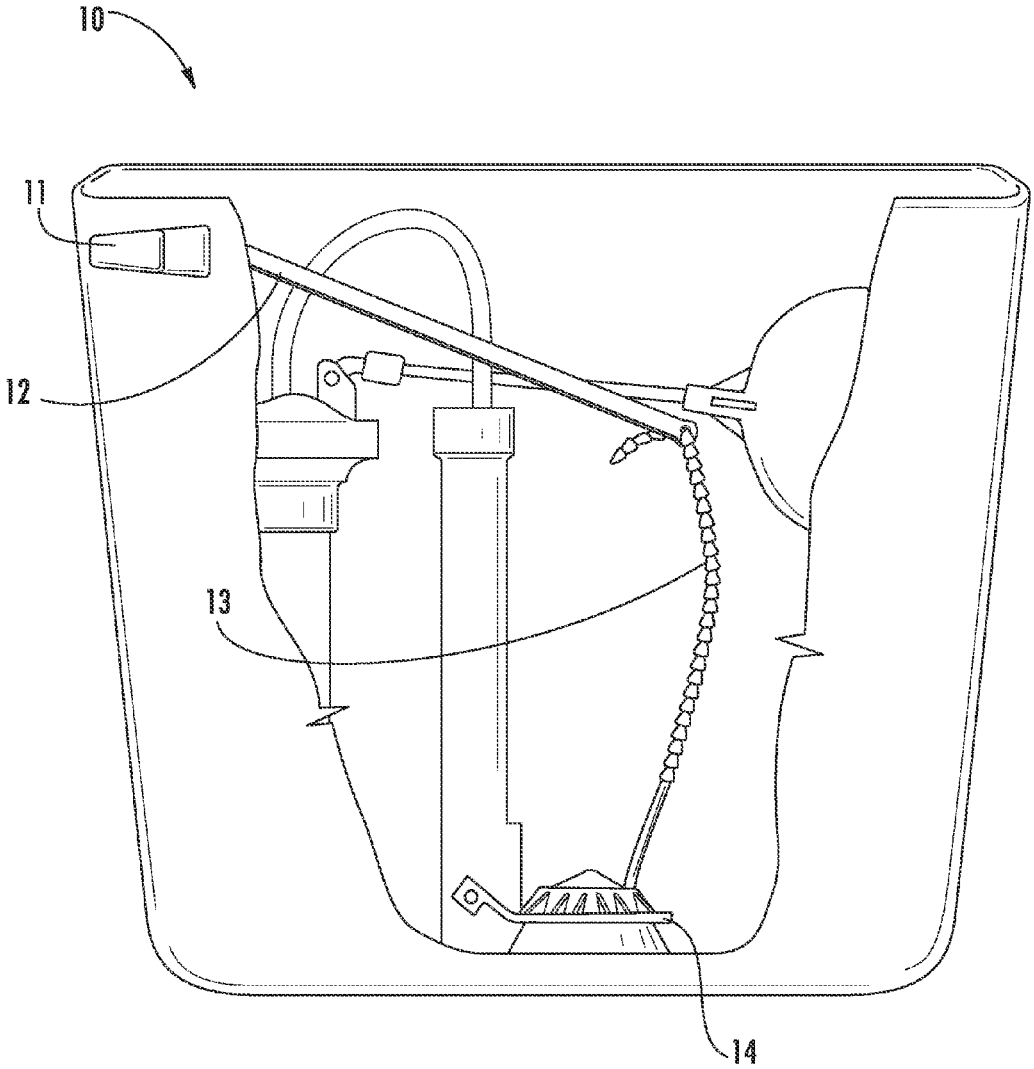
FIG. 1 (PRIOR ART)
FIG. 1 is a cutaway schematic view of a toilet including a conventional flush mechanism, according to the prior art.
Figure 2:
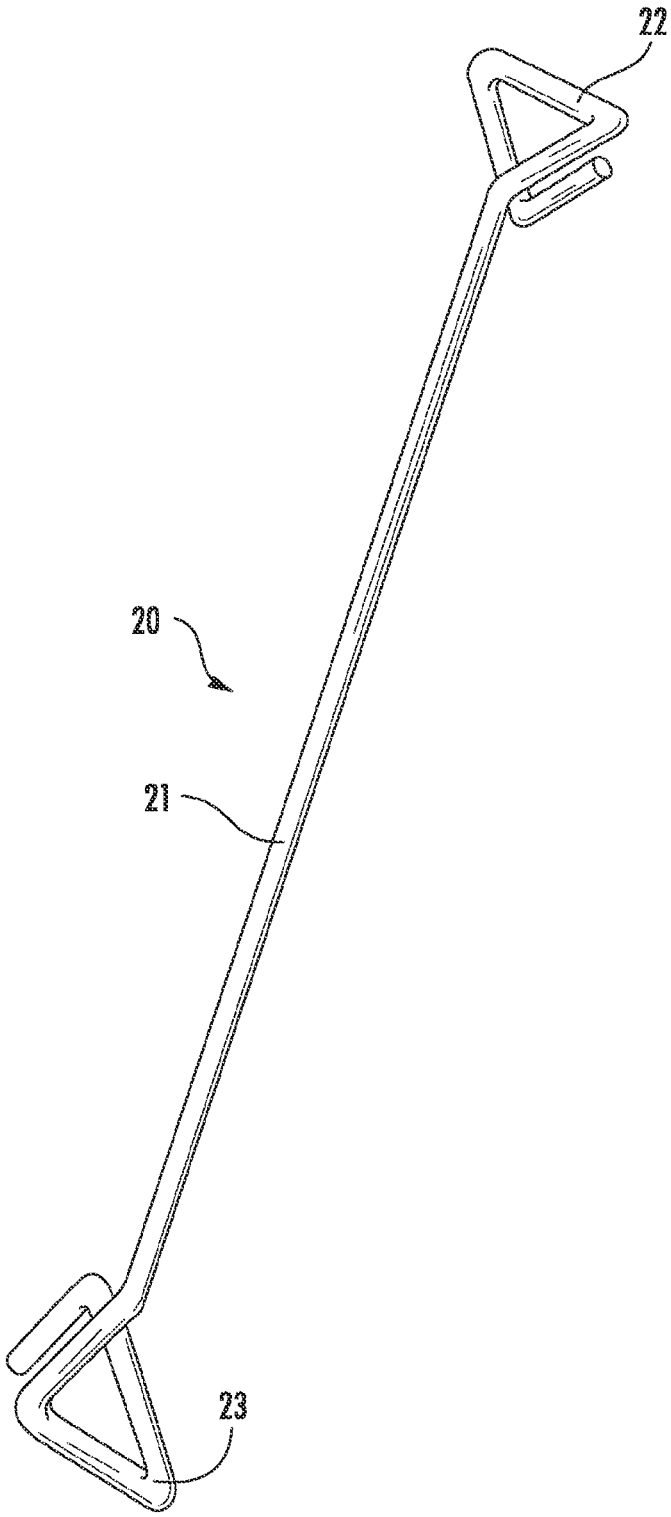
FIG. 2 is a front view of a monolithically formed flapper control rod for use in a toilet, in accordance with the present invention.

The present invention allows for the simple conversion of the conventional flush mechanisms that may waste water to a flush system allowing manual control of the flush volume. With reference to FIG. 2 initially, a flapper rod 20 to replace a conventional flapper chain is now described. This flapper rod is for use in a toilet comprising a tank, a bowl, a handle, a lever coupled to the handle, an opening defined between the tank and the bowl, and a flapper valve to seal the opening between the tank and the bowl.

This flapper rod 20 allows the conversion of a conventional chain and flapper mechanism to a system that allows manual closing the flapper at any point of the flush cycle, thereby allowing for water savings. The flapper rod 20 comprises an elongated member 21, carrying a respective attachment clip 22, 23 at each end. The attachment clips 22, 23 illustratively have a triangular shape and are for coupling the flapper rod 20 to the lever and the flapper valve. The flapper rod 20 is preferably constructed of a lightweight non-corrosive material, for example plastic, aluminium, brass or any suitable other material. The flapper rod 20 overall should be of a sufficient length to fit common toilet flush systems using a conventional flapper valve and chain system, thereby allowing easy retrofitting into existing installed toilets.

When a toilet including the flapper rod 20 is flushed, the handle is depressed and the lever therefore moves upward. The lever pulls upward on the flapper rod 20, which thereby opens the flapper valve, allowing water from the tank to drain into the bowl. The buoyancy of the flapper valve keeps the flapper valve open during the flush, but the buoyancy of the valve may be overcome by manual closure at any point in the flush cycle, for example when a user visually confirms that the contents of the bowl have been flushed away. That is, in a toilet employing the flapper rod 20, the flapper valve may be closed at any time during the flush by simply moving the handle in a direction opposite to the flush direction. Since the contents of the bowl may be flushed away before the majority of the water in the tank has been emptied into the bowl, the flapper rod 20 may allow for a significant saving of water.

Those of skill in the art will understand that one factor in the selection of the materials from which to construct the flapper rod 20 is the resulting weight thereof. The weight is of interest because the flapper valve may close prematurely and without manual input on the handle if the combined downward force caused by the force of gravity on the weight of the flapper rod 20 and lever are greater than the upward force caused by buoyancy on the flapper valve.

Installation of the flapper rod 20 into a conventional toilet is a simple process. To install the flapper rod 20, the flapper chain is disconnected from the lever and the flapper valve. The attachment clips 22, 23 are then coupled to the lever and the flapper valve, respectively, to complete the installation of the flapper rod 20.

Figure 3A:
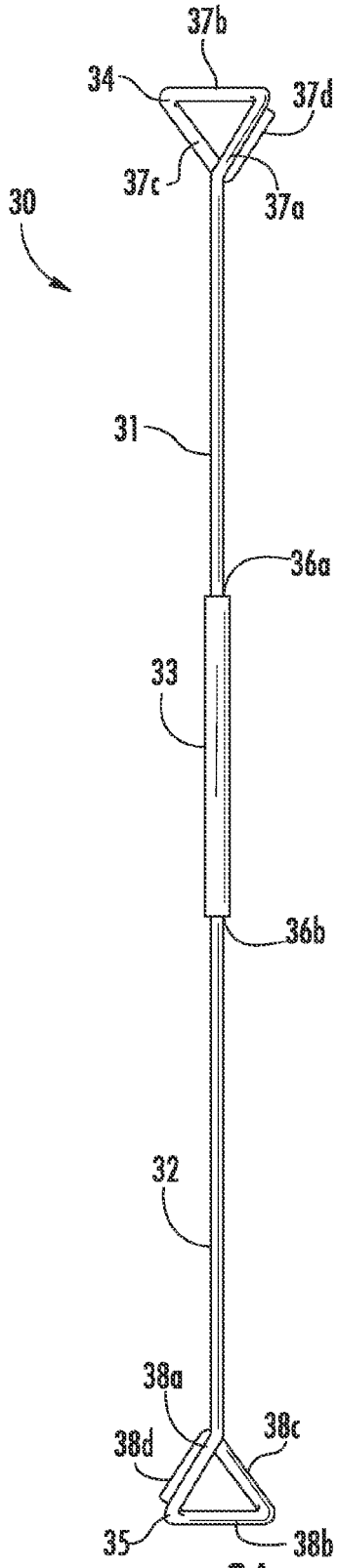
FIG. 3A is front view of another embodiment of a rigid, adjustable-length flapper control rod for use in a toilet, in accordance with the present invention.
Figure 3B:
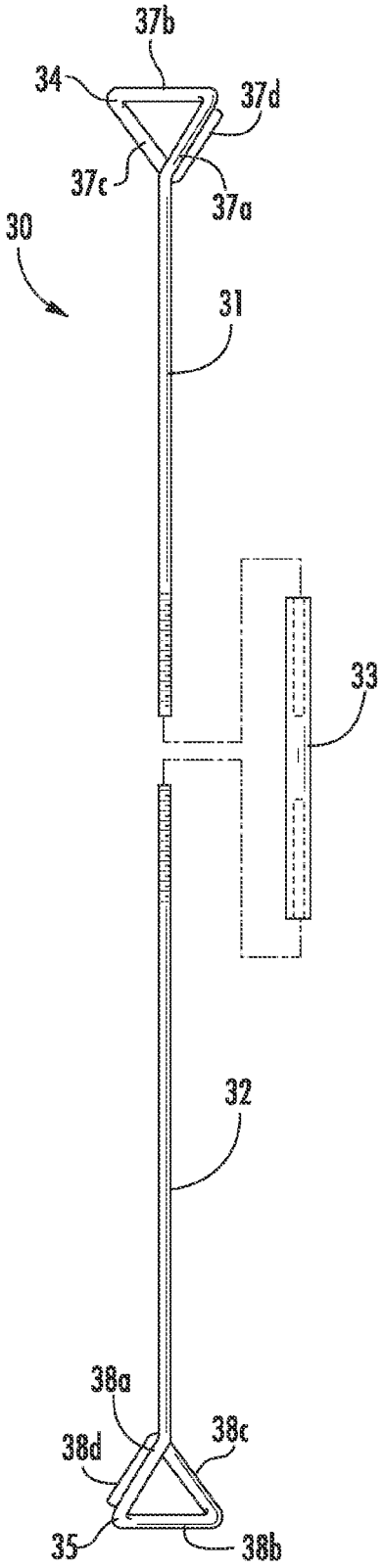
FIG. 3B is an exploded view of the rigid, adjustable-length flapper control rod of FIG. 3A.
Figure 4:
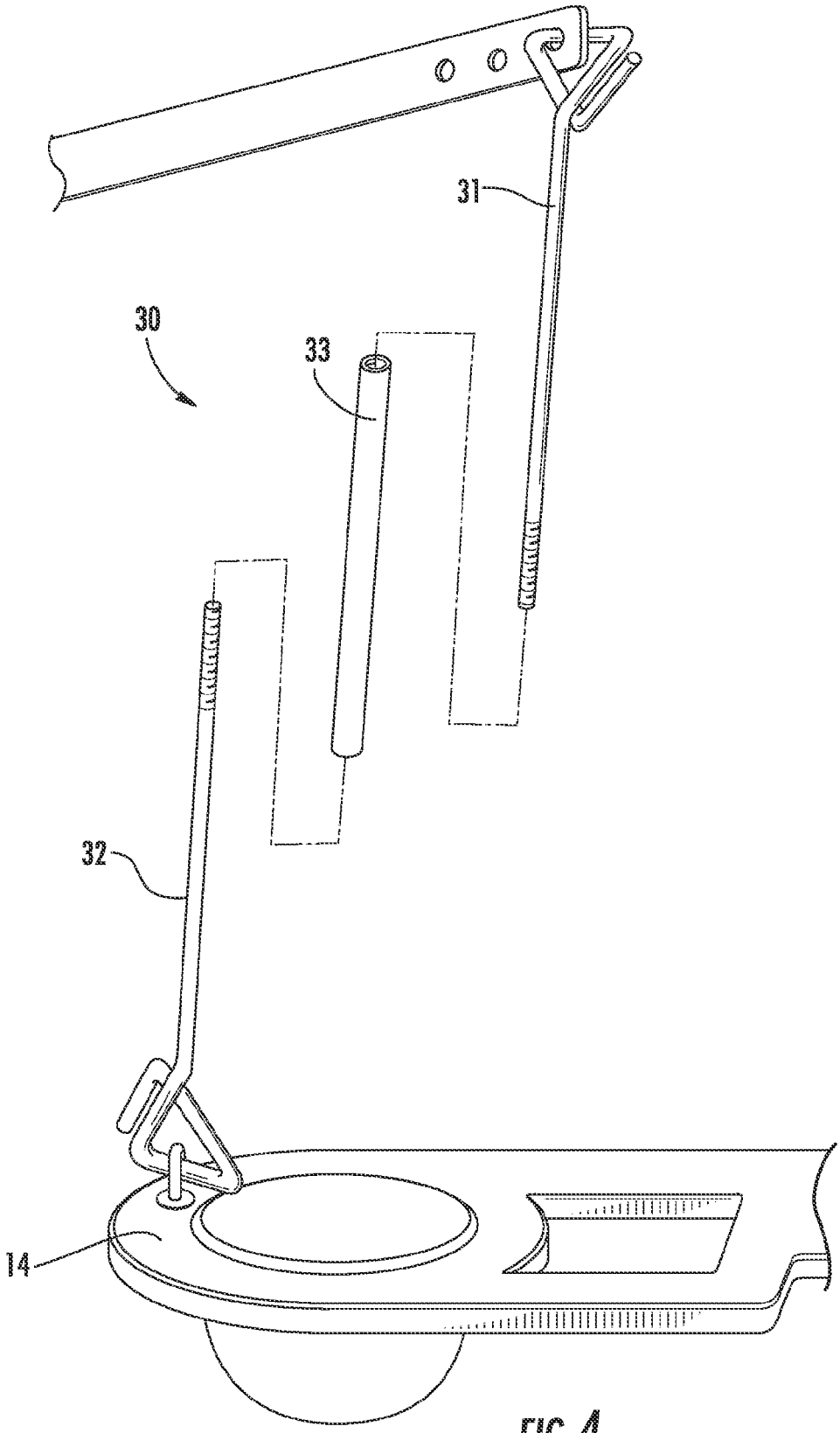
FIG. 4 is a front view of the rigid, adjustable-length flapper control rod of FIG. 3 during connection thereof to a flapper valve.

In some applications, it may be desirable for the length of the flapper rod 20 to be changeable. With respect to FIGS. 3A-4, an embodiment of a rigid flapper rod 30 having an adjustable-length is now described. The rigid, adjustable-length flapper rod 30 comprises a series of elongate segments 31, 32, 33 with adjustable joints 36*a*, 36*b* therebetween. The series of elongate segments 31, 32, 33 illustratively include a medial portion 33 to receive two end portions 31, 32. Coupled to each end portion 31, 32 opposite the medial portion 33 are first and second hook ends 34, 35 that function as attachment clips. The hook ends 34, 35 each illustratively have a triangular shape and comprise four continuous segments 37*a*-37*d*, 38*a*-38*d* with the first three segments 37*a*-37*c*, 38*a*-38*c* defining a triangle, and the fourth segment 37*d*, 38*d* lying parallel to the first segment 37*a*, 38*a* and in spaced relation therefrom. Those skilled in the art will understand that other shaped hook ends 34, 35 may be used. Indeed, a suitable hook end 34, 35 would advantageously limit slipping of the flapper rod 30 with respect to the lever or flapper valve during opening of the flapper valve or during manual closure of the flapper valve.

The medial portion 33 illustratively is a hollow threaded barrel with threaded female portions at its ends to receive threaded male portions of the end portions 31, 32. The threaded joints 36*a*, 36*b* formed between the end portions 31, 32 and the medial portion 33 have adjustable lengths. The medial portion 33 may be 80% of the overall length of the flapper rod 30, for example. It should be appreciated that the hollow construction of the medial portion 33 advantageously reduces the weight of the flapper rod 30, allowing the flapper valve to stay open due to buoyancy.

Of course, it should be understood that the medial portion 33 may instead have threaded male portions to be received by thread female portions of the end portions 31, 32. The threaded connection between the medial portion 33 and the end portions 31, 32 allows the varying of the length of the flapper rod 30, as the end portions may be screwed deeper into the medial portion to reduce the overall length of the flapper rod, or partially unscrewed from the medial portion to increase the overall length of the flapper rod. Moreover, different versions of the flapper rod 30 having different length end portions 31, 32 or medial portions 33 may be produced to allow for use with a wide variety of toilets.

Figure 5A:
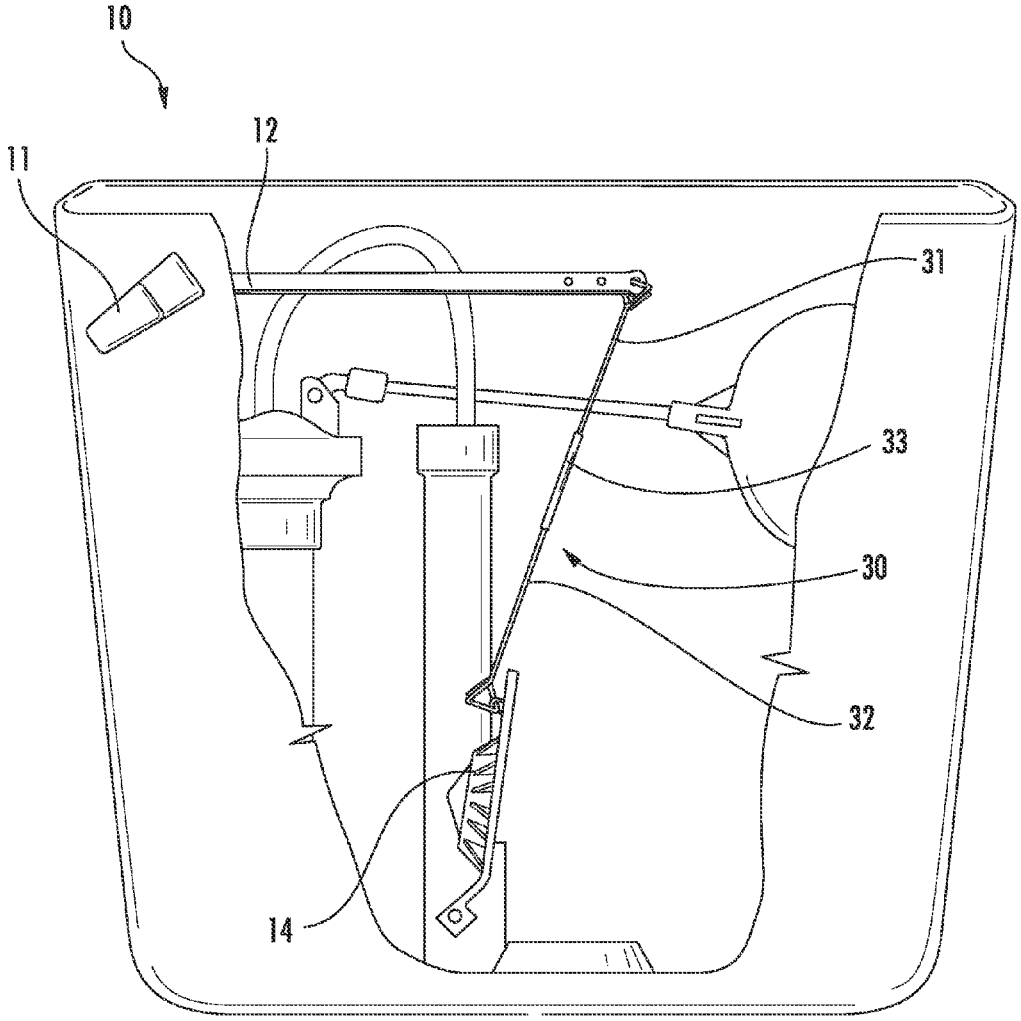
FIG. 5A is a schematic cutaway view of a toilet including the rigid, adjustable-length flapper control rod of FIG. 3 when the handle is being depressed to open the flapper valve.
Figure 5B:
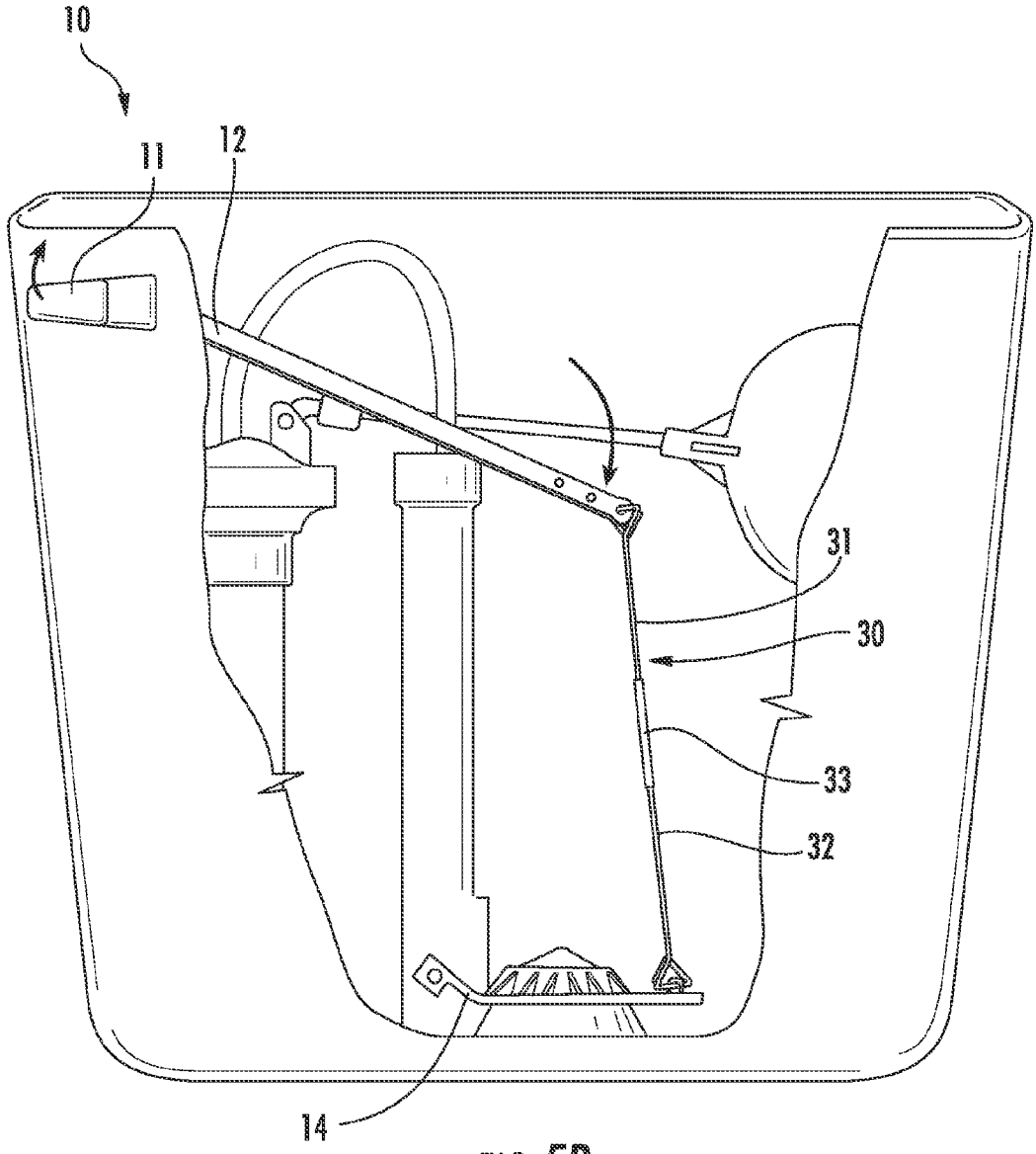
FIG. 5B is a schematic cutaway view of the toilet of FIG. 5B wherein the handle has been pushed upward, forcing the rigid, adjustable-length flapper control rod downward and the flapper valve to close.

The ability of the overall length of the flapper rod 30 to be altered is advantageous because proper sizing of the flapper rod 30 is helpful to ensure proper functioning of the toilet. That is, the flapper rod 30 should be short enough that the flapper valve can be fully opened by the lever (FIG. 5A). Further, the flapper rod 30 should be long enough to allow the flapper valve to seal the tank from the bowl (FIG. 5B).

If the flapper rod 30 is too short, the flapper valve may be held open due to the limited movement of the lever in most common systems used. This would not allow the flapper valve to drop far enough to form a seal between the tank and the bowl. In the same sense, the flapper rod 30 cannot be so long as to hinder the full opening of the flapper valve. If the flapper rod 30 is too long, the flapper valve may not be able to be fully opened because the lever may strike the top of the tank before the flapper is fully opened. If the flapper valve is not fully opened, then the weight of the lever and flapper rod 30 may overcome the buoyancy of the flapper valve and it may close prematurely when manual input is not applied.

Installation of the flapper rod 30 into an existing toilet would include the removal of the flapper chain. The end portion 32 would then be attached to the flapper valve, and the end portion 31 would similar be attached to the lever. The medial portion 33 would be positioned between the end portions 31, 32 which would then be screwed into the medial portion. The over length of the flapper rod 30 may than be adjusted to allow proper functioning by screwing or unscrewing the end portions 31, 32 into our out of the medial portion 33 until the overall length of the flapper rod 30 is sufficient to allow closure of the valve.

It should be understood that other suitable methods of adjustably coupling the end portions 31, 32 to the medial portion 33 may be used and that threads need not be used in all applications. For example, rather than threaded joints 36*a*, 36*b*, friction joints may be used.

Figure 6:
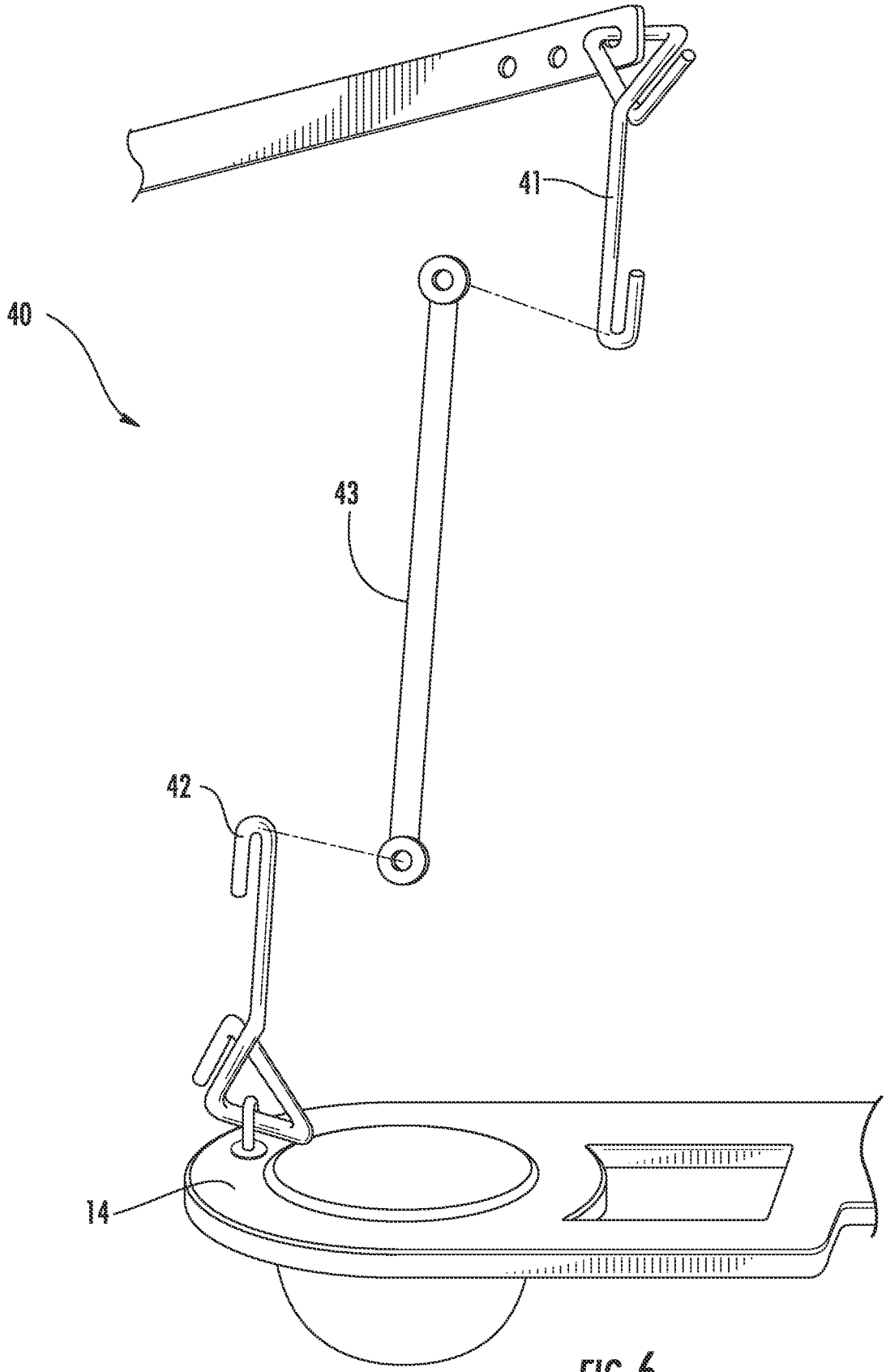
FIG. 6 is a front view of an alternative embodiment of a rigid, adjustable-length flapper control rod for use in a toilet, according to the present invention.
Figure 7:
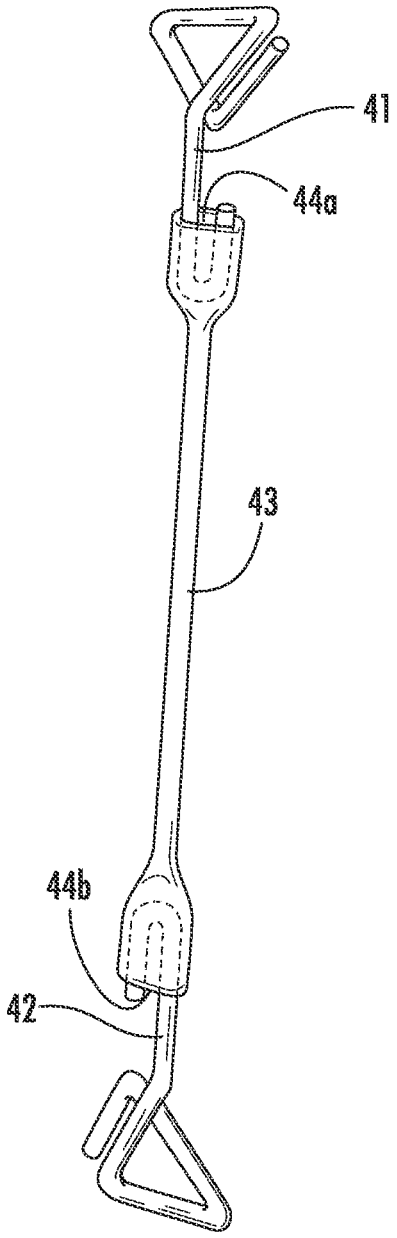
FIG. 7 is a front view of the rigid, adjustable-length flapper control rod of FIG. 6, assembled.

A further embodiment of a rigid, adjustable-length flapper rod 40 is now described with reference to FIG. 6. The flapper rod 40 comprises a series of elongate segments 41, 42, 43. Here, first and second end portions 41, 42 are hook ends. The medial portion 43 is hollow with female ends that mate with male ends of the first and second end portions 41, 42 to thereby form slidable friction joints. FIG. 7 illustrates the flapper rod 40 with the first and second end portions 41, 42 coupled to the medial portion 43 via slidable friction joints 44*a*, 44*b*.

The flapper rod 40 of this embodiment operates similarly to the flapper rods 20, 30 described above and therefore requires no further discussion. Those skilled in the art will appreciate that the invention disclosed herein includes not only the flapper rod 20, 30, 40 but also methods of making the flapper rod and methods of using the flapper rod.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included as readily appreciated by those skilled in the art.

That which is claimed is:

1. A flush toilet configured to permit user control of a flush cycle time and corresponding water usage, the toilet comprising:

a bowl;

a tank in fluid communication with said bowl;

a flush handle assembly carried by said tank and comprising a flush handle and a lever arm coupled thereto;

a flapper valve in said tank; and a rigid, adjustable-length, flapper control rod coupled between said lever arm and said flapper valve so that operation of said flush handle in a first direction causes said rigid, adjustable-length flapper control rod to pull open said flapper valve and so that operation of said flush handle in a second direction causes said rigid, adjustable-length, flapper control rod to push closed said flapper valve thereby permitting user control of the flush cycle time and corresponding water usage said rigid, adjustable-length flapper rod comprising a body portion with first and second hook ends, at least one of said first and second hook ends comprising four continuous segments with the first three segments defining a triangle and the fourth segment lying parallel to the first segment and in spaced relation therefrom.

2. The flush toilet of claim 1, wherein said rigid, adjustable-length flapper rod comprises a series of elongate segments with at least one adjustable length joint therebetween.

3. The flush toilet of claim 2, wherein said at least one adjustable length joint comprises at least one threaded joint.

4. The flush toilet of claim 2, wherein adjacent elongate segments have threaded ends; and wherein said at least one adjustable length joint comprises a threaded barrel receiving the threaded ends.

5. The flush toilet of claim 2, wherein said at least one adjustable length joint comprises at least one slidable friction joint.

6. The flush toilet of claim 5, wherein adjacent elongate segments have corresponding male and female ends defining said at least one slidable friction joint.

7. A flapper control rod for a flush toilet configured to permit user control of a flush cycle time and corresponding water usage, the toilet comprising a bowl, a tank in fluid communication with the bowl, a flush handle assembly carried by the tank and comprising a flush handle with a lever arm coupled thereto, and a flapper valve in the tank, the flapper control rod comprising:

a rigid, adjustable-length, flapper control rod to be coupled between the lever arm and the flapper valve so that operation of the flush handle in a first direction causes said rigid, adjustable-length flapper control rod to pull open the flapper valve and so that operation of the flush handle in a second direction causes said rigid, adjustable-length, flapper control rod to push closed the flapper valve thereby permitting user control of the flush cycle time and corresponding water usage;

said rigid, adjustable-length flapper rod comprising a body portion with first and second hook ends with threaded ends coupled thereto, with first and second adjustable threaded joints between the first and second hook ends and the body portion, at least one of said first and second hook ends comprising four continuous segments with the first three segments defining a triangle and the fourth segment lying parallel to the first segment and in spaced relation therefrom.

8. A flapper control rod for a flush toilet configured to permit user control of a flush cycle time and corresponding water usage, the toilet comprising a bowl, a tank in fluid communication with the bowl, a flush handle assembly carried by the tank and comprising a flush handle with a lever arm coupled thereto, and a flapper valve in the tank, the flapper control rod comprising:

a rigid, adjustable-length, flapper control rod to be coupled between the lever arm and the flapper valve so that operation of the flush handle in a first direction causes said rigid, adjustable-length, flapper control rod to pull open the flapper valve and so that operation of the flush handle in a second direction causes said rigid, adjustable-length, flapper control rod to push closed the flapper valve thereby permitting user control of the flush cycle time and corresponding water usage;

said rigid, adjustable-length flapper rod comprising a body portion and first and second hook ends coupled thereto, with first and second adjustable slidable friction joints between the first and second hook ends and the body portion, at least one of said first and second hook ends comprising four continuous segments with the first three segments defining a triangle and the fourth segment lying parallel to the first segment and in spaced relation therefrom.

9. A method of retrofitting a toilet to permit user control of a flush cycle time and corresponding water usage, the toilet comprising a bowl, a tank in fluid communication with the bowl, a flush handle assembly carried by the tank and comprising a flush handle with a lever arm coupled thereto, and a non-rigid, flapper control member coupled between the lever arm and a flapper valve in the tank, the method comprising:

removing the non-rigid flapper control member;

coupling a rigid, adjustable-length, flapper control rod between the lever arm and the flapper valve so that operation of the flush handle in a first direction causes said rigid, adjustable-length, flapper control rod to pull open the flapper valve and so that operation of the flush handle in a second direction causes said rigid, adjustable-length, flapper control rod to push closed the flapper valve thereby permitting user control of the flush cycle time and corresponding water usage, the rigid, adjustable-length flapper rod comprising a body portion with first and second hook ends, at least one of the first and second hook ends comprising four continuous segments with the first three segments defining a triangle and the fourth segment lying parallel to the first segment and in spaced relation therefrom.

10. The method of claim 9, wherein the rigid, adjustable-length flapper rod comprises a series of elongate segments with at least one adjustable length joint therebetween.

11. The method of claim 10, wherein the at least one adjustable length joint comprises at least one threaded joint.

12. The method of claim 10, wherein adjacent elongate segments have threaded ends; and wherein the at least one adjustable length joint comprises a threaded barrel receiving the threaded ends.

13. The method of claim 10, wherein the at least one adjustable length joint comprises at least one slidable friction joint.

* * * * *